United States Patent [19]

Saylor et al.

[11] 4,378,742

[45] Apr. 5, 1983

[54] HOLD DOWN BAR FOR HOPPER CAR HATCH COVERS

[75] Inventors: James R. Saylor; Lewis H. Wiens, both of Johnson County, Kans.; Orville E. Blume, Buchanan County, Mo.

[73] Assignee: Aero Plastics of K.C., Inc., Kansas City, Mo.

[21] Appl. No.: 239,322

[22] Filed: Mar. 2, 1981

[51] Int. Cl.[3] ..... B61D 39/00; B63B 19/00

[52] U.S. Cl. ..... 105/377; 114/203; 220/324; 292/256.5

[58] Field of Search ..... 52/49, 51, 52, 55; 105/247, 248, 377; 220/324, 325; 114/201 R, 203; 292/256.5

[56] References Cited

U.S. PATENT DOCUMENTS 4,239,008 12/1980 Conlon ..... 114/201 R X

*Primary Examiner*—Robert B. Reeves
*Assistant Examiner*—David F. Hubbuch
*Attorney, Agent, or Firm*—Kokjer, Kircher, Bradley, Wharton, Bowman & Johnson

[57] ABSTRACT

An insert for a hold down bar which serves to hold down adjacent hatch covers of a railroad hopper car. The hold down bar includes an inverted channel, and the insert includes a rigid bar which carries a resilient gasket. The bar can be bolted in the channel with the gasket located to seal against the end of the hatch cover when the hold down bar is located down on the cover. The insert is used when an older hatch cover having a rain bar is replaced by a replacement cover that lacks a rain bar. The insert occupies half of the channel so that a second identical insert can be added if two adjacent hatch covers are replacement covers without rain bars.

11 Claims, 5 Drawing Figures

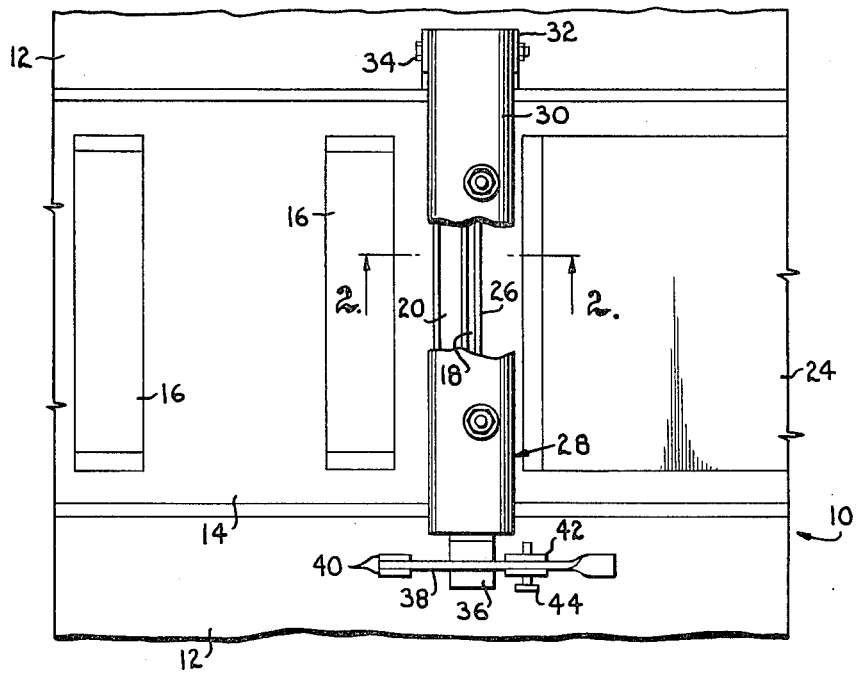
Fig. 1.
Fig. 2.
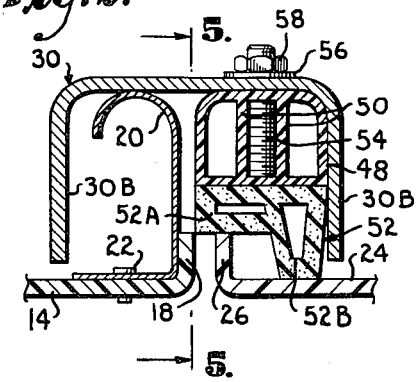
Fig. 3.
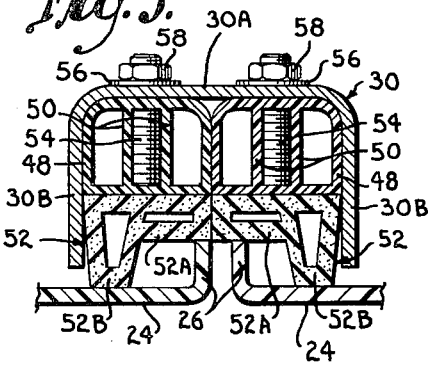
Fig. 4.
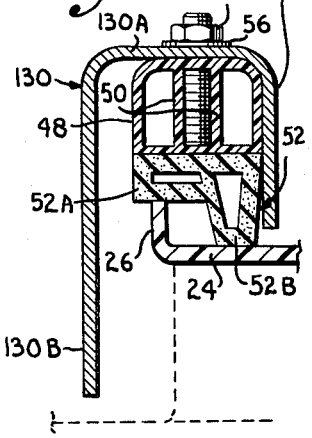
Fig. 5.
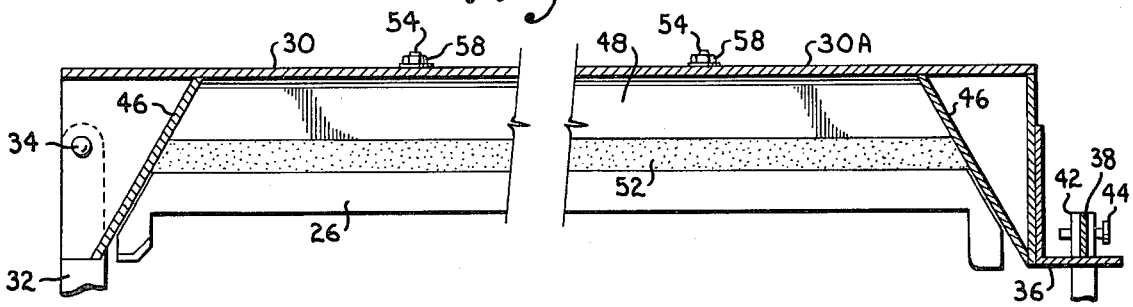

HOLD DOWN BAR FOR HOPPER CAR HATCH COVERS

BACKGROUND AND SUMMARY OF THE INVENTION

This invention relates in general to hold down bars which serve to hold down the hatch covers of railroad covered hopper cars. More specifically, the invention deals with an insert which is installed in the hold down bar when the hatch covers are replaced.

As the hatch covers which fit the opening of covered railroad hopper cars become damaged or otherwise unfit for further use, it becomes necessary to replace them. The replacement covers are normally newer style covers that lack the metal rain bar which is common on the ends of older style hatch covers. For cost reasons, replacement of the hatch covers is normally made only when necessary. It is a common situation for only one cover to need replaced out of the total of four on the car.

The hold down bars that cover the ends of adjacent hatch covers and serve to hold them closed on the hopper cars are specifically designed for use with the older style hatch covers. The hold down bar typically includes an inverted channel which covers the rain bars of the two adjoining hatch covers when latched in the hold down position. Hold down bars of this type function well with the older style hatch covers but are totally incompatible with the newer covers since they do not prevent moisture and other foreign material from entering the hopper car and possibly contaminating the grain or other contents of the railcar. A serious problem is thus encountered each time a hatch cover is replaced in that the rain bar style hold down is not compatable with the new style of hatch cover. Without rain bars, it has been necessary to always replace rain bar style hatch covers with the same type of cover. This is true unless the owner wishes to replace all four hatch covers and all four hold down bars to convert the car to the new style hatch covers.

The present invention has, as its primary goal, the provision of an insert which can be installed in an existing hold down bar to adapt the bar for effective service in holding down and sealing a newer style hatch cover that lacks a rain bar. It is a particularly important feature of the invention that the insert permits the bar to be used either with two of the newer style hatch covers or with one new cover and one old cover. In accordance with the invention, the insert includes a rigid bar which carries a resilent gasket and which can be secured in the channel of the existing hold down bar. The insert occupies one side of the channel, and the gasket is located to seal against the end of the replacement cover. If the adjacent hatch cover is an older style cover having a rain bar, the other side of the channel remains open and covers the rain bar. When the second hatch cover is replaced, another insert is installed in the other side of the channel to seal against the end of the second replacement cover. Thus, the existing hold down bar accommodates either two replacement covers or one replacement cover and one older style cover. In addition, a single insert can be installed in the channel forming the end hold down bar when the end hatch cover is replaced.

DETAILED DESCRIPTION OF THE INVENTION

In the accompanying drawing which forms a part of the specification and is to be read in conjunction therewith and in which like reference numerals are used to indicate like parts in the various views:

FIG. 1 is a fragmentary top plan view of a railroad hopper car which is equipped with hatch covers and a hold down bar constructed according to a preferred embodiment of the present invention, with a portion of the hold down bar broken away for illustrative purposes;

FIG. 2 is a fragmentary section view on an enlarged scale taken generally along line 2—2 of FIG. 1 in the direction of the arrows and showing the hold down bar used with one old style hatch cover and one new style replacement cover;

FIG. 3 is a fragmentary sectional view similar to FIG. 2, but with the old style hatch cover replaced by a newer style replacement cover and a second insert installed on the hold down bar to accommodate the second replacement cover;

FIG. 4 is a fragmentary sectional view showing an insert installed on an end hold down bar in accordance with the present invention; and FIG. 5 is a fragmentary sectional view taken generally along line 5—5 of FIG. 2 in the direction of the arrows, with the break lines indicating continuous length.

Referring now to the drawing in more detail and initially to FIG. 1, numeral 10 generally designates a conventional railroad hopper car. The hopper car is open at the center and includes a pair of walkways 12 on opposite sides of the open center. The center of the hopper car is normally closed by a plurality of hatch covers which are arranged end to end along the length of the car. The hatch covers may be swung in a well known manner between open and closed position about hinges (not shown).

The hatch covers originally installed on the hopper car are typically of the style indicated at 14 in FIG. 1. These older style hatch covers 14 each have a plurality of raised ribs 16 on their upper surfaces and upstanding flanges 18 (see FIG. 2) on their opposite ends. A metal rain bar 20 is secured adjacent each end flange 18 by rivets 22. The rain bars 20 serve as deflectors which prevent rain and other contaminants from entering the hopper car past the flanges 18.

The original hatch covers 14 eventually become cracked or otherwise damaged to an extent requiring replacement. Replacement of the damaged hatch covers is normally made by providing improved, newer style hatch covers such as that indicated by numeral 24 in FIG. 1. The replacement hatch covers 24 are not equipped with rain bars or other deflectors on their ends. An upstanding flange 26 similar to flange 18 is provided on each end of the replacement covers 24.

The hatch covers are held down on top of the hopper car by hold down bars, one of which is generally designated by numeral 28 in FIG. 1. There is one hold down bar between each adjacent pair of hatch covers and an end hold down bar at the end of each end cover. Each hold down bar 28 is in the form of an inverted metal channel 30 having a central web 30A and side flanges 30B. Each channel 30 is received at one end within a hinge bracket 32 mounted on the hopper car. A bolt 34 is extended through the hinge bracket and the flanges of the channel to provide a horizontal hinge axis about which the channel can be raised and lowered.

The end of each channel 30 opposite the hinge is provided with a tongue plate 36. A locking bar 38 engages the tongue plate 36 to hold channel 30 down on top of the hatch covers. Each locking bar 38 is pivotally connected at one end between a pair of lugs 40 extending upwardly from the railcar. When the locking bar 38 is swung downwardly, it is received with a clevis 42. A pin 44 can be inserted through clevis 42 and bar 38 to lock the bar down on top of tongue plate 36. Each hold down bar can be released by removing pin 44 and raising locking bar 38 out of the clevis and away from the tongue plate 36.

As best shown in FIG. 5, each channel 30 is closed at its opposite ends. A pair of inclined plates 46 are secured within the channel adjacent each end. Plates 46 angle inwardly as they extend upwardly to connection at their top edges with web 30A of the channel.

The hold down bars 30 are specially constructed to hold down the older style hatch covers 14. When used with the old style hatch covers, each hold down bar 28 can be locked down on top of the ends of adjacent hatch covers by the locking bar 38. In this position, channel 30 covers the adjacent ends of the hatch covers and engages the curved upper ends of the rain bars 20 in order to prevent foreign material from passing into the gap presented between the ends of the covers. Release of the hatch covers is accomplished by removing pin 44, swinging locking bar 38 upwardly to release the hold down bar, and swinging the hold down bar upwardly about the hinge axis provided by bolt 34. The hatch covers can then be raised to provide access to the interior of the hopper car. When one or more of the older style hatch covers 14 are replaced with the newer style hatch covers 24, hold down bars 28 are not able to effectively hold down the replacement hatch covers or prevent moisture and other contaminants from leaking into the hopper car. Since there is no rain bar or other rain deflector on the newer hatch covers 24, moisture and other foreign material can pass into channel 30 and enter the hopper car through the gap presented between the ends of the adjacent hatch covers.

In accordance with the present invention, this problem is overcome by installing one or more inserts in each hold down bar 28 associated with a replacement cover. Each insert includes a rigid bar 48 of sufficient length to extend between the inclined plates 46 of the hold down bar. The width of each bar 48 is approximately equal to or slightly less than half the width of channel 30 between the side flanges 30B. Bar 48 essentially provides a hollow shell which contains therein a pair of longitudinal ribs 50 extending the length of the bar. The opposite ends of the bar are beveled to accommodate the angled plated 46, as best shown in FIG. 5. The upper edges of each bar 48 are rounded to conform with the rounded interior surfaces of channel 30 at the intersections between web 30A and sides 30B.

A compressible gasket 52 is glued or otherwise secured to the bottom surface of each insert bar 48. Gasket 52 is constructed of a resilient material such as neoprene. Each gasket has a body portion 52A which is hollow at the center and a projecting lip 52B which extends downwardly from body 52 along the outer edge thereof. The lip 52B tapers as it extends away from the body portion of the gasket and has a tapered space interiorly of the lip. Gasket 52 has the same width as bar 48 and substantially the same length. The opposite ends of gasket 52 are beveled to accomodate plates 46, as shown in FIG. 5.

Each insert may be secured within channel 30 by a pair of threaded bolts 54. Each bolt 54 is secured between the two ribs 50 of bar 48 and projects upwardly beyond the top of the insert bar. The projecting ends of bolts 54 can be passed through openings formed in web 30A, and each bolt end receives a washer 56 and a nut 58 in order to secure the insert to the hold down bar 28.

With reference to FIG. 2, one insert assembly is installed on the hold down bar if the bar is to be used with one old style hatch cover 14 and an adjacent newer style replacement cover 24. The insert occupies one side of channel 30 and the other half of the channel remains open such that it can cover the rain bar 20 on the old style cover. When the hold down bar is in its latching position on top of the adjacent ends of the hatch covers, body portion 52A of gasket 52 is compressed against the top edge of flange 26 in order to effect a seal, and the projecting lip 52B seals against the adjacent surface of the hatch cover to provide another seal. In this manner, the hold down bar is adapted to hold down both covers 14 and 24 and to seal against the replacement cover 24 in order to prevent the entry of moisture and other foreign material. Body portion 52A of the gasket is wide enough to accommodate variations in the gap between the covers while still sealing against flange 26.

When the second hatch cover is replaced by a replacement cover, a second insert is installed in the hold down bar as shown in FIG. 3. The two inserts are secured in channel 30 in side by side relationship, with each occupying approximately ½ of the channel. When the hold down bar is in the latching position, both of the replacement covers 24 are held down and sealed by the gaskets 52. The insert bars 48 closely contact the sides 30B and web 30A of the channel and are shaped to accommodate the shape of the channel for a snug fit therein.

It is thus apparent that the insert provided by the present invention adapts the existing hold down bar 28 for use with either one old style cover 14 and one new style cover 24 (FIG. 2), or with two new style covers 24 (FIG. 3). Consequently, the older hatch covers can be replaced one at a time when necessary, and an insert can be added to the hold down bar at each end of the new replacement cover without requiring a completely new hold down bar or extensive modifications thereof. It is contemplated that the inserts will be offered in kit form for convenient installation in the field. The inserts can also be secured to the hold down bar as original equipment if the hold down bar is to be used with two of the newer style hatch covers.

FIG. 4 illustrates the channel 130 of an end hold down bar which serves to hold down the end of the hatch cover at each end of the hopper car. Channel 130 is virtually identical with channels 30 except that its outer flange 130B is considerably deeper than its inner flange 130C. When used with an old style hatch cover having a rain bar 20, channel 130 covers the rain bar with its web 130A contacting the curved upper portion of the rain bar. Flange 130 of the channel extends well below the end of the hatch cover in order to effectively prevent the entry of foreign material.

When an end hatch cover in the old style is replaced by a newer replacement cover 24, the insert of the present invention is installed in channel 130, as shown in FIG. 4. The insert bar 48 and gasket 52 are secured against the inner flange 130C. When channel 130 is latched down on top of the end of the hatch cover, the insert assures that it will effectively hold down the hatch cover.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, we claim:

1. In a hold down bar arrangement having a channel member adapted to cover one end of a hopper car hatch cover, means mounting the channel member on the hopper car for pivotal movement between latching and release positions relative to the hatch cover, and releasable means for maintaining the channel member in the latching position to hold down the hatch cover, an insert for the channel member comprising:

a rigid insert bar adapted to be inserted in the channel member;

means for securing said insert bar in the channel member; and a resilient gasket carried on said insert bar at a location to seal against said one end of the hatch cover in the latching position of the channel member.

2. The invention set forth in claim 1, wherein the hatch cover is a replacement hatch cover without a rain deflector and the channel member is sized to cover said one end of the replacement hatch cover and an adjacent end of a second hatch cover which carries a rain deflector, the channel member being open in the portion thereof which covers said adjacent end of the second hatch cover.

3. The invention set forth in claim 1, wherein the hopper car includes a second hatch cover having an end adjacent said one end of the first mentioned hatch cover and the channel member is sized to cover the adjacent ends of the first and second hatch covers in the latching position of the channel member, and including:

a second rigid insert bar adapted to be inserted in the channel member side by side with the first mentioned insert bar;

means for securing said second insert bar in the channel member in side by side relationship with the first insert bar; and a second resilient gasket carried on said second insert bar at a location to seal against said end of the second hatch cover in the latching position of the channel member.

4. The invention set forth in claim 1, wherein the hatch cover has a flange on said one end projecting generally upwardly from an adjacent surface of the hatch cover, said gasket including:

a compressible body portion sealing against said flange in the latching position of the channel member; and a lip portion projecting generally downwardly from said body portion at a location to seal against said adjacent surface of the hatch cover in the latching position of the channel member.

5. The invention set forth in claim 4, wherein said body and lip portions of the gasket are hollow.

6. The invention set forth in claim 1, wherein said insert bar includes:

a rigid shell presenting a substantially open interior space therein; and a pair of generally parallel ribs extending within said interior space of the shell lengthwise therein.

7. A hold down bar for holding down adjacent ends of a pair of hopper car hatch covers, at least one of which is a replacement hatch cover without a rain deflector, said hold down bar comprising:

a channel member mounted to the hopper car for pivotal movement between a latching position wherein the channel member covers said adjacent ends of the hatch covers to hold them down and a release position wherein the channel member releases the hatch covers to permit opening thereof;

releasable means for maintaining said channel member in the latching position thereof;

a gasket secured in said channel member at a location to seal against the end of said one hatch cover in the latching position of the channel member; and wherein the other hatch cover has a rain deflector adjacent the end thereof, said channel member having an open portion thereof covering said rain deflector in the latching position of the channel member.

8. A hold down bar for holding down adjacent ends of a pair of hopper car hatch covers, at least one of which is a replacement hatch cover without a rain deflector, said hold down bar comprising:

a channel member mounted to the hopper car for pivotal movement between a latching position wherein the channel member covers said adjacent ends of the hatch covers to hold them down and a release position wherein the channel member releases the hatch covers to permit opening thereof;

releasable means for maintaining said channel member in the latching position thereof;

a gasket secured in said channel member at a location to seal against the end of said one hatch cover in the latching position of the channel member;

wherein the other hatch cover has a rain deflector adjacent the end thereof, said channel member having an open portion thereof covering said rain deflector in the latching position of the channel member; and a rigid insert bar secured in said channel member, said gasket being attached to said insert bar.

9. A hold down bar as set forth in claim 8, wherein the end of said one hatch cover includes a flange projecting above an adjacent surface of the hatch cover, said gasket including:

a body portion located to seal against said flange in the latching position of the channel member; and a lip portion projecting from said body portion generally away from said rigid insert bar and located to seal against said adjacent surface of the hatch cover in the latching position of the channel member.

10. An insert structure for a channel shaped hold down bar used to hold down adjacent ends of a pair of hopper car hatch covers, at least one of which is a replacement cover without a rain deflection bar, said insert structure comprising:

a rigid insert bar having a length substantially equal to the length of the hold down bar and a width no greater than half the width of the channel presented by the hold down bar;

means for securing said insert bar in the channel presented by the hold down bar; and a resilient gasket secured to said insert bar and extending substantially the length of the hold down bar at a location to seal against the end of said replacement cover when the hold down bar is positioned to hold down the hatch covers.

11. An insert structure as set forth in claim 10, wherein said replacement cover includes a flange projecting above an adjacent surface of the cover, said gasket having a body portion sealing against said flange and a projecting lip portion sealing against said adjacent surface when the hold down bar is positioned to hold down the hatch covers.

* * * * *